US008963788B2

(12) United States Patent
Lucidarme et al.

(10) Patent No.: US 8,963,788 B2
(45) Date of Patent: Feb. 24, 2015

(54) ANTENNA SYSTEM WITH BALANCED MOUNT

(75) Inventors: Thierry Lucidarme, Montigny-le-Bx (FR); Marc Touret, Colombes (FR)

(73) Assignee: Thales, Neuilly sur Seine (FR)

( * ) Notice: Subject to any disclaimer, the term of this patent is extended or adjusted under 35 U.S.C. 154(b) by 550 days.

(21) Appl. No.: 13/380,720

(22) PCT Filed: Jun. 21, 2010

(86) PCT No.: PCT/EP2010/058729
§ 371 (c)(1),
(2), (4) Date: Feb. 21, 2012

(87) PCT Pub. No.: WO2010/149619
PCT Pub. Date: Dec. 29, 2010

(65) Prior Publication Data

US 2012/0268333 A1 Oct. 25, 2012

(30) Foreign Application Priority Data

Jun. 26, 2009 (FR) ..... 09 03131

(51) Int. Cl.
*H01Q 3/08* (2006.01)
*H01P 1/161* (2006.01)
(Continued)

(52) U.S. Cl.
CPC ..... *H01P 1/161* (2013.01); *H01Q 1/18* (2013.01); *H01Q 3/08* (2013.01); *H01Q 19/19* (2013.01)
USPC ..... 343/763; 343/757

(58) Field of Classification Search
CPC ..... H01Q 19/19; H01Q 3/08; H01Q 1/18
USPC ..... 343/763, 757, 761, 765, 766
See application file for complete search history.

(56) References Cited

U.S. PATENT DOCUMENTS 6,577,281 B2 * 6/2003 Yamamoto et al. ..... 343/766
2001/0028327 A1 * 10/2001 Yamamoto et al. ..... 343/757
(Continued)

FOREIGN PATENT DOCUMENTS

EP 0171149 A1 2/1986

OTHER PUBLICATIONS

Maurice A. Meyer, et al: "Applications of the Turnstile Junction," IRE Transactions on Microwave Theory and Techniques, IEEE, USA, vol. 6, No. 6, Dec. 1, 1955, pp. 40-45.
(Continued)

*Primary Examiner* — Hoanganh Le
(74) *Attorney, Agent, or Firm* — Baker and Hostetler LLP

(57) ABSTRACT

An antenna system includes at least one antenna and one X-Y mount, said mount being composed of at least three mechanical elements, the first element being a base, the second element being a lower box, the third element being a upper box, the antenna of the system being fixed to the upper box. The components of the antenna downlead are distributed in the various elements composing the X-Y mount, an OMT type junction included in the upper box enabling separation of the components of the downlead into two separate paths, a first path called the ascending path comprising components for amplifying and processing signals to be transmitted by the antenna, a second path called the descending path comprising components for processing and amplifying signals received by the antenna, the components associated with these paths being placed on either side of the various elements of the X-Y mount.

10 Claims, 4 Drawing Sheets

(51) Int. Cl.
*H01Q 1/18* (2006.01)
*H01Q 19/19* (2006.01)

(56) References Cited

U.S. PATENT DOCUMENTS

| | | | | |
|---|---|---|---|---|
| 2003/0117335 | A1 | 6/2003 | Bien et al. | |
| 2008/0084357 | A1 | 4/2008 | Smeltzer | |
| 2009/0231224 | A1 * | 9/2009 | Felstead et al. | 343/766 |

OTHER PUBLICATIONS

Andrew J. Rolinski, et al.: "Satellite-Tracking Characteristics of the X-Y mount for Data Acquisition Antennas," NASA Technical Note D-1697, Washington, D.C., Jun. 1964.

G. Craven, et al.: "Waveguide Antenna Switches Using p-i-n. Diodes," Electronics Letters, Aug. 18, 1977, vol. 13, No. 17.

* cited by examiner

ANTENNA SYSTEM WITH BALANCED MOUNT

CROSS-REFERENCE TO RELATED APPLICATIONS

This application is a National Stage of International patent application PCT/EP2010/058729, filed on Jun. 21 2010, which claims priority to foreign French patent application No. FR 0903131, filed on Jun. 26, 2009, the disclosures of which are incorporated by reference in their entirety.

FIELD OF THE INVENTION

The invention concerns an antenna system with a balanced mount and applies notably to the fields of electronics and telecommunications, for example satellite telecommunications.

It may also be used in related fields such as radar or microwave beams.

BACKGROUND

In space communications in the C, X, Ku, Ka, etc. band, with one or more satellites, some transmit/receive stations are equipped with antenna systems comprising a mount, said mount enabling the antenna to be pointed automatically at a traffic satellite, regardless of the position thereof in the sky. In other words, the mount enables adaptation of the transmitting and/or receiving direction of the antenna of the system. This adaptation is useful if, for example, an antenna on the ground must track the position of satellites in non-geostationary orbit. This feature is also useful if the antenna is onboard a mobile vehicle that must enable a communication link with a given satellite to be maintained. The equipment to which the antenna is fixed, i.e. the mount, must enable dynamic positioning thereof.

A plurality of types of mount exist in the prior art. For example, a mount of elevation over azimuth type may be used. The latter enables movement of the antenna about two axes, the first being the azimuth axis and the second the elevation axis. Its use is relatively inappropriate in the context of satellite telecommunication applications, notably when said satellites are at a high elevation. In fact, a singular point at the zenith is inherent to elevation over azimuth mounts. When the antenna is being elevated, i.e. when it is moving about the elevation axis, and reaches the zenith of its trajectory, the mount must effect a fast rotation of 180° about the azimuth axis for the antenna to continue its movement. The consequence of this rotation is rapid wear of the mount. Moreover, if said rotation is not fast enough, the current call may be interrupted.

A second family of mounts also exists. These are three-axis mounts. They have no singular point, but are bulky and relatively costly. Moreover, their high weight makes it difficult to envisage onboard use on small devices, notably on pilotless aircraft, also called "drones".

It is also possible to use an electronically scanned antenna and dispense with the use of a mount, but this solution nevertheless encounters difficulties linked to its cost and its lack of precision.

A compromise suitable for satellite communications is obtained by the use of X-Y type mounts. These notably enable prevention of the occurrence of the singular point at the zenith and minimization of the weight and size of said mount. The singular point is not found at the zenith, as is the case for elevation over azimuth mounts, but horizontally, which is less problematic in the context of satellite applications, notably when the latter are positioned at high altitude (high-elevation satellites). This type of mount is compared to mounts of the elevation over azimuth type in the paper by A. J. Rolinski, D. J. Carlson and R. J. Croates entitled *Satellite-tracking characteristics of the X-Y mount for data acquisition antennas*, NASA technical note D-1697, Washington, D. C., June 1964.

In the remainder of the description, the movement of the antenna induced by the mount of the system of the invention may be described within a three-dimensional orthonormal frame of reference. The x and y axes are contained within the plane to which the base of the mount is fixed. By definition, the third axis z is perpendicular to that plane. If an X-Y mount is used, the movement of the antenna is the consequence of two rotation movements about two rotation axes/shafts X and Y, denoted by uppercase letters, unlike the axes x, y, z of the orthonormal frame of reference. The rotation axes X and Y are represented and their links with the various mechanical elements constituting the X-Y mount are highlighted in the remainder of the description.

Given the mechanical structure of X-Y mounts, balancing the various elements constituting them is then crucial and must be taken into account at the design stage and also to avoid having excessively high moments of inertia and serious and rapid wear, notably when the antenna in onboard an airframe. Thus it is important to balance the various elements of the antenna downlead included in the mount.

SUMMARY OF THE INVENTION

One aim of the invention is notably to alleviate the aforementioned drawbacks.

To this end, the invention consists in an antenna system comprising at least one antenna and one X-Y mount, said mount being composed of at least three mechanical elements, the first element being a base, the second element being a so-called lower box, the third element being a so-called upper box, the antenna of the system being fixed to the upper box. The components of the antenna downlead are distributed in the various elements composing the X-Y mount, an OMT type junction included in the upper box enabling separation of the components of the downlead into two separate paths, a first path called the ascending path comprising components for amplifying and processing signals to be transmitted by the antenna, a second path called the descending path comprising components for processing and amplifying signals received by the antenna, the components associated with these paths being placed on either side of the various elements of the X-Y mount.

In one embodiment, the OMT junction is of the turnstile type, said junction being composed of a central part and four coplanar arms disposed in a cross around the central part, two of the coplanar arms being used as short circuits, the other two coplanar arms being respectively connected to the ascending path and to the descending path of the antenna downlead, and a circular arm corresponding to the horn of the antenna of the system.

For example, the two short circuit arms are removable and interchangeable.

The short circuit arms may be the same length, at least one electrically controlled PIN diode being placed in these two arms at a chosen distance from the base of the arm in such manner as to adjust the length of the short circuit according to whether the diode is open or closed.

In one embodiment, the lower box is connected to the base by a first shaft for rotation about an axis X, the upper box being connected to the lower box by a second shaft for rotation about an axis Y, the axes X and Y being chosen in such manner that they do not intersect.

In another embodiment, the lower box is connected to the base by a first shaft for rotation about an axis X, the upper box being connected to the lower box by a second shaft for rotation about an axis Y, the axes X and Y being chosen in such manner that they are in the same plane.

For the paths of the antenna downlead conductivity between the components of the same path is ensured from one element to the other of the mount, for example, by the use of simple microwave rotary joints.

For example, the base comprises a cold box containing at least one power amplifier associated with the ascending path, said box being cooled by the use of a cold plate fixed to the base.

According to another aspect of the invention, at least one hydraulic actuator is fixed to the cold plate and to the support on which the antenna system rests, said actuator being controlled electrically or mechanically in such manner as to introduce a static inclination angle between the antenna system and the support.

According to a further aspect of the invention, at least one linear electric motor is fixed to the cold plate and to the support on which the antenna system rests, said motor being electrically controlled in such manner as to introduce a static angle of inclination between the antenna system and the support.

BRIEF DESCRIPTION OF THE DRAWINGS

Other features and advantages of the invention will become apparent in the light of the following description given by way of nonlimiting illustration and with reference to the appended drawings, in which.

DETAILED DESCRIPTION

Figure 1B:
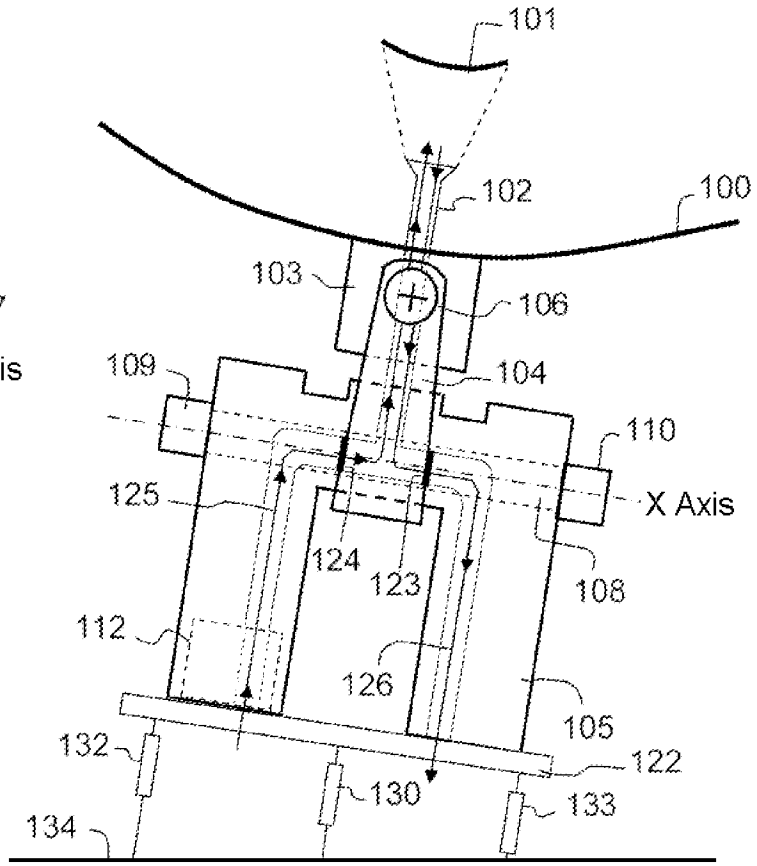
FIG. 1*b* corresponds to the same antenna system as figure 1*a*, but shown in the xz plane.
Figure 1A:
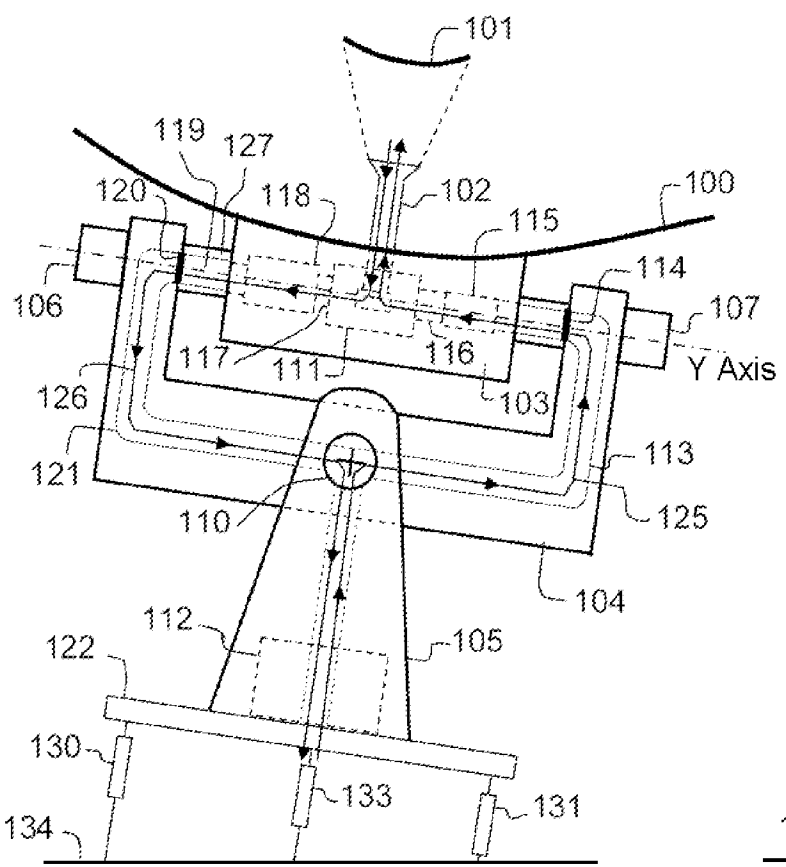
FIG. 1*a* shows in the yz plane an example of an antenna system of the invention with two offset rotation axes.

FIG. 1*a* shows in the yz plane an example of an antenna system of the invention with two offset rotation axes. The antenna is of the Cassegrain type, for example. In this case, it is composed of a primary reflector 100, for example of parabolic shape, a secondary reflector 101 and a horn 102 used as a source and enabling illumination of the primary reflector. The horn may be corrugated to minimize the power of the secondary lobes of the signals transmitted and received. This type of antenna offers very good performance for circular polarization signals.

The mount associated with this antenna is composed of three main elements. The first element 103 to which the antenna is fixed is called the upper box. The second element 104 is called the lower box, said element being connected to the upper box 103 by a mechanical rotation shaft. This shaft is associated with one or more motors 106, 107 situated at its ends and enables rotation movement of the upper box 103 about a rotation axis Y aligned with the mechanical shaft. The third element is the base of the mount 105 and is connected to the lower box 104 by a second mechanical rotation shaft, the lower box being moved by two motors 109, 110 situated on either side of said shaft, for example. This second shaft enables rotation movement of the lower box 104 relative to a rotation axis X aligned with the second mechanical shaft.

The antenna downlead, which is one of the various elements of the mount, comprises a plurality of electronic and mechanical components enabling processing of analog signals transmitted and received by the antenna. When designing the X-Y mount it is important to balance all the components of the system. If the elements of the antenna downlead are judiciously distributed in the mount, the general balancing of the system is improved. The antenna system of the invention enables quasi-symmetrical distribution of the components of the antenna downlead within the upper box 103, the lower box 104 and the base 105 of the mount. This symmetry is made possible by using an orthomode transducer (OMT) type microwave circulator 111. This OMT 111 is placed in the upper box 103 and is connected to the horn 102 of the antenna. Its function is to separate processing and routing within the mount of the signals transmitted and the signals received by the antenna. The electromagnetic signals are usually polarized differently according to whether they are transmitted or received by the antenna system. For example, the transmitted signals may have right-hand circular polarization and the received signals left-hand circular polarization. The OMT is a polarization duplexer and thus enables separation of transmission and reception for independent processing at the level of the antenna downlead.

In this case, these transmitted and received signals use the same horn 102 at the level of the antenna, for example. At the level of the mount, the signals are processed and transmitted differently after separation by the OMT 111. Thus received signals are routed from the antenna toward the exterior of the mount using a path 126, called the descending path in the remainder of the description, said path being implemented between an output of the OMT and an output of the mount, for example the output at the level of the base 105.

The second path 125, called the ascending path in the remainder of the description, is used for processing and transmitting to the antenna the signals to be transmitted. This dissociation of the ascending path 125 and the descending path 126 enables distribution of the components associated with them on either side of the mount and thus improved balancing.

The ascending path used for transmission comprises a cold box 112. This cold box contains, for example, a power amplifier followed by a block up converter (BUC). If the amplifier is a high-power amplifier and a sufficiently effective ventilation system may not be used, the use of a liquid-cooled plate 122, called a cold plate, may be envisaged, fixed to the base 105 of the mount. This solution is notably suitable if the antenna is onboard a pilotless airframe. In fact, amplifiers with a power rating of the order of 300 W may be used. Moreover, at high altitude, the air is thin, which renders ventilation of the electronic equipments particularly difficult.

Moreover, the cold plate 122 fixed to the base 105 of the mount may be in motion relative to the surface 134 to which the antenna system is fixed. Actuators 130, 131, 132, 133 fixed to the edges of said plate enable adjustment of the overall orientation of the system, for example. Such a mechanism makes it possible to use the antenna system of the invention to track a satellite at low elevation by configuring a static angle of inclination of the system relative to its support (134).

The actuators are hydraulic actuators, for example, and may be controlled electronically by an antenna computer or mechanically.

An alternative solution to hydraulic actuators is to use linear electric motors. Thus variable reluctance motors may be used. It is equally possible to use conventional rotary gear-motors and conversion of the circular movement into movement in translation, i.e. of the "lead screw" type, this embodiment having the advantage of relatively low cost.

The antenna system of the invention may use at least one actuator or one base motor and advantageously four. If four actuators or motors are used, they may be positioned at the edges of the cold plate 122, for example, two 132, 133 being positioned on the X axis and the other two 130, 131 on the Y axis.

The BUC included in the cold box 112 has the function of converting a signal occupying a given frequency band into a signal occupying a higher frequency band. In applications for which the signals to be transmitted are satellite signals, conversion is usually from the intermediate L band to one of the Ku, C or Ka bands. The remainder of the description takes by way of example an antenna system using an intermediate band in band L and a transmit/receive band in band Ka. The BUC may be produced using a phase-locked loop using an external reference frequency, for example of the order of 10 MHz. The signal is then routed through the lower box 104 by means of a waveguide 113 to the upper box 103 and a transmit filter 115 used notably to decouple the transmit path effectively from the receive path and image frequencies. The waveguides notably used in the mount may be rigid or flexible, and are of coaxial cable type, for example.

Figure 3:
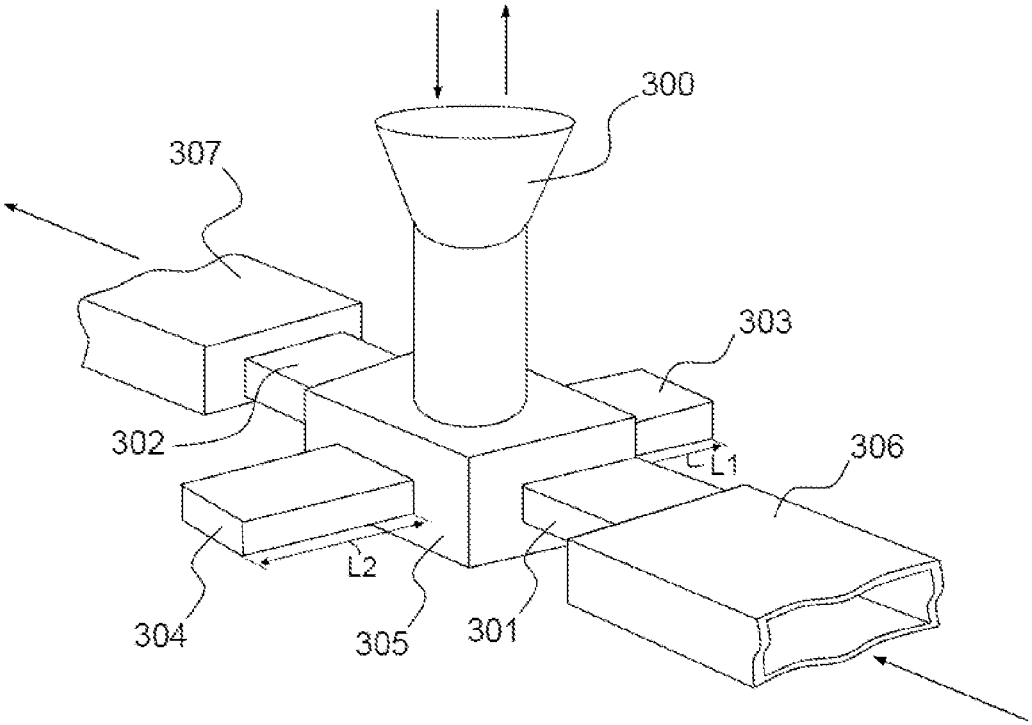
FIG. 3 shows an example of a turnstile junction that may be used by the antenna system of the invention.

A waveguide section 116 then enables the signal to reach the OMT junction 111 and to be transmitted by the horn of the antenna, the OMT junction being common to the ascending and descending paths. This junction may be of the "turnstile" type, for example, as shown in FIG. 3 and described hereinafter. Simple rotary seals 114, 124 optimize for operation in band Ka are used to maintain the connectivity between the waveguide sections on movement in rotation of the various elements of the mount relative to each other.

The descending path 126 used for processing and routing to the exterior of the antenna system signals received by the antenna is composed, for the part contained in the upper box 103, of a microwave line section 117 connected to an output of the OMT junction and a low-noise amplifier block (LNB) followed by a frequency converter 118 for converting from the Ka band to the L band, for example. Following amplification and conversion 118, the signal is transmitted to the upper box 104 by another waveguide section 119. A simple rotary joint 120 is used to join said waveguide section 119 contained within the upper box 103 and another waveguide section 121 contained within the lower box 104, as well as allowing for the movement in rotation of the upper box 103 relative to the lower box 104, i.e. maintaining the conductivity between the two waveguide sections. The section 121 of the lower box has the function of transmitting the signal to the base 105 of the positioning system. The junction between the lower box and the base is also via a simple rotary joint 123. The two joints of the descending path therefore operate in the intermediate frequency band, i.e. in band L in the context of this example.

Turning to the antenna downlead of the descending path, it is therefore possible to place the low-noise amplifier 118 as close as possible to the antenna in the upper box and advantageously to use coaxial cables for the descending path of the signal to the lower box.

In an alternative embodiment, the low-noise amplifier may be situated in the lower box and the descending path of received signals may, for example, include a rigid waveguide with low-losses in the receiving band. In this case the mount comprises four simple joints functioning in the receiving band.

The use of an OMT junction to separate the two paths notably has the advantage of avoiding the use of double rotary microwave joints, the cost of which is high. Moreover, the power losses caused by leakage currents are greater than when simple joints are used.

FIG. 1*b* corresponds to the same antenna system as FIG. 1*a*, but shown in the xz plane.

The representation in the xz plane corresponds to 90° rotation of the FIG. 1*a* representation. The upper box 103 therefore appears at the side and the OMT junction the transmit and receive filters are not shown for reasons of clarity, because they are situated behind one of the motors 106 of the rotation axis Y.

The base 105 is shown lengthwise. The mechanical shaft 108 for rotation about X passing through said base 105 is shown with, on either side of said shaft, a motor 109, 110 for turning the lower box. The ascending path 125 and the descending path 126 appear dissociated at the level of the two feet of the base 105. Two simple joints 123, 124 functioning in band L for the ascending path and in band Ka for the descending path are used to enable transmission of signals in transit on the ascending path 125 and the descending path 126 to the junction of the waveguides of the base 105 and the lower box 104. The rotary joints providing the junction of the waveguide sections of the lower box 104 and the upper box 103 are not shown in FIG. 1*b* but are seen in FIG. 1*a*.

Figure 2B:
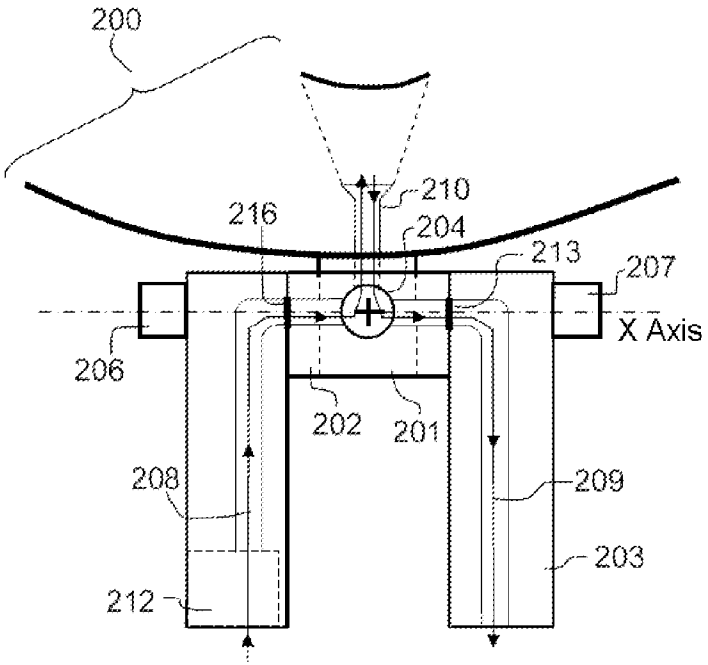
FIG. 2*b* shows the same example as FIG. 2*a* but shown in the xz plane.
Figure 2A:
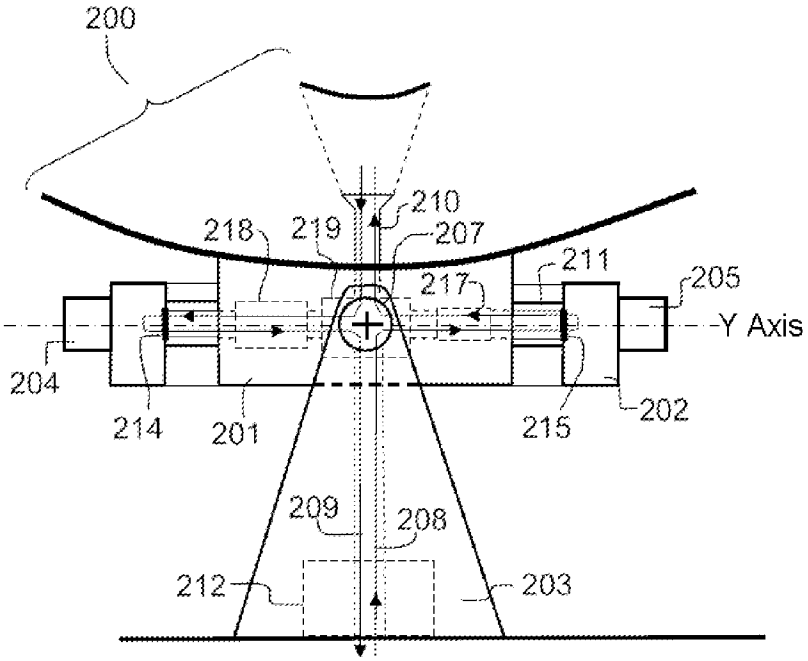
FIG. 2*a* shows in the yz plane an example of an antenna associated with a positioning system of the invention the rotation axes of which are concurrent.

FIG. 2*a* shows an example of an antenna associated with a positioning system of the invention the rotation axes of which are concurrent, shown in the yz plane. FIG. 2*b* shows the same example as FIG. 2*a* but shown in the xz plane.

The orientation of the antenna 200, composed of two reflectors and a horn 210, is controlled by the mount. The antenna downlead, contained in said mount, is based on the same principle as in the example from FIGS. 1*a* and 1*b*, i.e. the ascending path 208 and the descending path 209 are separated using an OMT type microwave circulator 219.

The two shafts for rotation about the X and Y axes are perpendicular and in the same plane. A lateral box 202 and an internal box 201 respectively correspond to the upper box 103 and to the lower box 104 of the mount with offset rotation axes described above. The base 203 contains the cold box 212 containing the power amplifier and the BUC.

For example, two motors 204, 205 transmit to the internal box a rotation movement about the shaft 211 on the axis Y. For the rotation about the axis X, two other motors 206, 207 may be used. The axes X and Y are in the same plane. Consequently, the four motors are also positioned in the same plane, which contributes to balancing the antenna and the mount. A block 218 containing the low-noise amplifier and the receive filter is situated in the internal box 201 on the descending path 209.

The transmit filter 217 is situated in the internal box 201 on the ascending path 208. The OMT junction 219 between the two paths is also inside the internal box 201.

The mount comprises four simple joints.

An L band first simple rotary joint 214 joins the waveguide portions of the internal box 201 and the external box 202 for the descending path.

An L band second simple rotary joint 213 joins the waveguide portions of the external box 202 and the base 203 for the descending path.

A Ka band third simple rotary joint 216 joins the waveguide portions of the internal box 201 and the external box 202 for the ascending path.

A Ka band fourth simple rotary joint 215 joins the waveguide portions of the external box 202 and the base 203 for the ascending path.

Figure 2C:
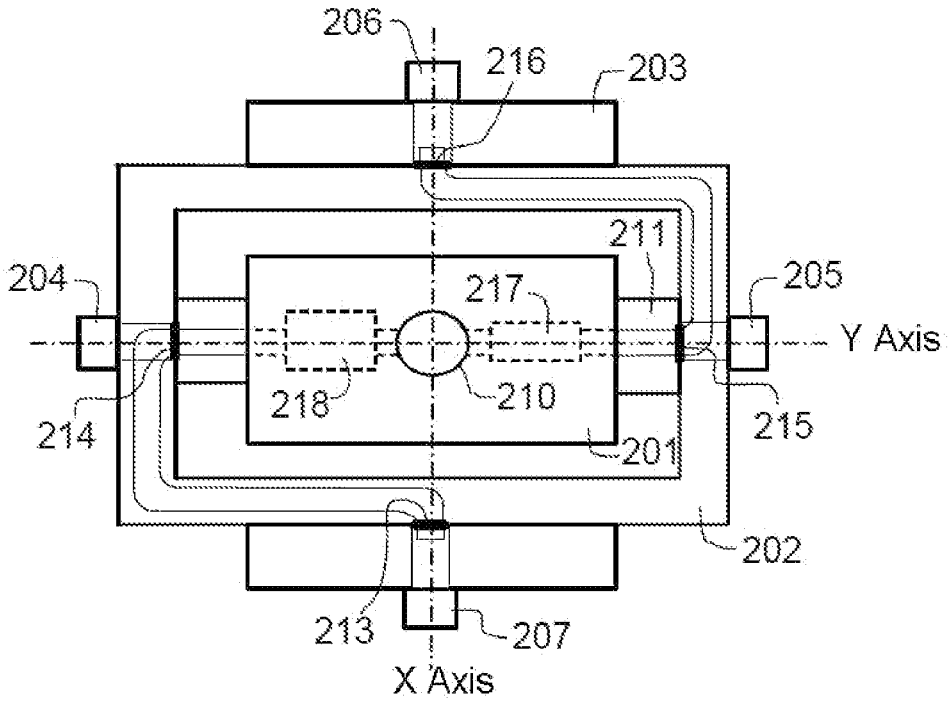
FIG. 2*c* is a top view (in the xy plane) of the antenna system of the example from FIGS. 2*a* and 2*b;*

FIG. 2*c* is a view from above in the xy plane of the antenna system with concurrent rotation axes. For clarity the reflectors of the antenna are not shown. The horn 210 is apparent at the center of the figure. At the junction of the internal box 202 and the external box 203 are seen the simple L band joints 213, 214 associated with the descending path and the simple Ka band joints 215, 216 associated with the ascending path.

FIG. 3 shows an example of a turnstile junction that may be used by the antenna system of the invention. The paper by of M. A. Meyer and H. B. Goldberg entitled *Applications of the Turnstile Junction*, IRE Transactions on Microwave theory and techniques, December 1955, describes the properties and the applications that may be envisaged for such a device. In antennas used for satellite communications, it is usual to employ a "septum" type polarizer placed in the horn of the antenna, for example. It enables reception of a circular polarization signal and a rectilinear polarization to be obtained at the output. Reciprocally, rectilinear-circular conversion is achieved in the other direction, for transmission.

A turnstile junction is equivalent to a polarizer and a duplexer. Consequently, if it is used, the use of a septum polarizer is therefore not required. This generally prevents losses linked to the use of a rectangular/circular type waveguide transition and moreover allows flexibility at the level of polarization switching. Moreover, the use of the turnstile junction is suitable for the symmetrical distribution of the paths of the antenna system of the invention, whereas it is difficult to find compact rectilinear OMT that have this type of symmetry.

A turnstile junction is composed of a central part 305, four coplanar arms 301, 302, 303, 304 disposed in a cross around the central part, and a circular arm 300. The circular arm corresponds to the horn of the antenna system and is used both as an inlet and as an output for signals received and transmitted by the system, said signals being circularly polarized.

Two aligned coplanar arms 301, 302 are used as input and output, respectively, for linearly polarized signals routed by the junction and corresponding to the entry points of the ascending path and the descending path described above.

The other two coplanar arms 303, 304, also aligned, are used as short circuits. If a linearly polarized signal is introduced into the inlet arm 301, a signal with a power substantially equal to half the incident power is transmitted in the horn 300, and the remaining half is separated into equal parts in the two short circuit arms 303, 304. The signal resulting from reflection within these arms 303, 304 and then the central part of the junction 305 is also transmitted to the output of the junction by the horn. The resulting signal at the output of the horn is then circularly polarized.

Based on the same principle, a circularly polarized signal received at the level of the horn may be converted into a rectilinear polarization signal at the output 302 of the junction.

The use of a turnstile junction consequently enables such a duplexer to separate within the mount the ascending path and the descending path respectively corresponding to the signals transmitted and the signals received by the same antenna, as described hereinabove.

For said separation to be effective, the choice of the length of the short circuits must conform to certain rules. In fact, the lengths L1 and L2 of the two short circuit arms 303, 304 must conform to the following equations:

$$L1 = \frac{\lambda}{8}(1 + 4n) \tag{1}$$

$$L2 = \frac{\lambda}{8}(3 + 4n) \tag{2}$$

in which:

λ is the wavelength of the signal propagating in the waveguide;

n is any positive integer.

It is consequently apparent that the length L2 is λ/4 greater than the length L1.

The two short circuit arms 303, 304 may be removable. It is then possible to interchange them. In this case, the input 306 and the output 307 of the turnstile junction respectively corresponding to the ascending path and to the descending path are reversed. Thus the antenna system may be reconfigured manually and support different polarization configurations of the incoming and outgoing signals at the level of the horn 300 of the antenna.

Figure 4:
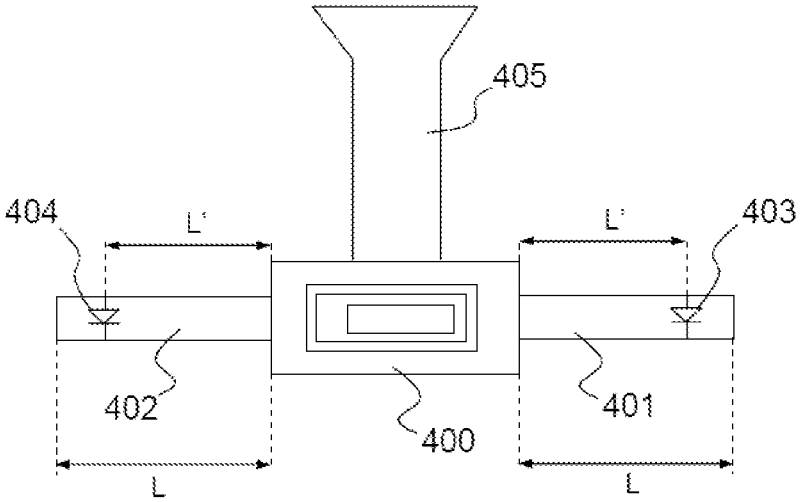
FIG. 4 shows an example of a turnstile junction comprising a short circuit reconfiguration mechanism.

FIG. 4 shows a symbolic example of a turnstile junction comprising a short circuit reconfiguration mechanism. The first arm 401 and the second arm 402 used for the short circuit are the same length L. Each arm includes at least one circuit including at least one PIN diode 403, 404 behaving as a switch and situated at a distance L' from the origin of the arm.

An example of the use of PIN diodes in the context of waveguide antennas is given in the paper by G. Craven and R. R. Thomas entitled *Waveguide Antenna Switches Using p-i-n Diodes*, Electronics Letters, 18 Aug. 1977, Vol. 13, n° 17.

These diodes enable adjustment of the length of the short circuits L1 and L2 of each arm and are controlled electrically, these two lengths having to meet the constraints expressed by the equations (1) and (2) explained above. For example, two short circuit configurations may be used:

| | | |
|---|---|---|
| Configuration 1: | L1 = L; | L2 = L'; |
| Configuration 2: | L1 = L'; | L2 = L. |

For configuration 1, for example, if for the first arm 401, L1=L=7λ/8 and for the second arm 402, L2=L'=5λ/8, the diode 403 of the first arm 401 must be open and the diode 404 of the second arm 402 must be closed.

The choice of L and L' must notably guarantee that the two short circuits have a length difference equal to λ/4.

The invention claimed is:

1. An antenna system comprising:

at least one antenna, one antenna downlead enabling processing of analog signals transmitted and received by the antenna, and one X-Y mount, said mount being composed of at least three mechanical elements, the first element being a base, the second element being a so-called lower box, the third element being a so-called upper box, the antenna of the system being fixed to the upper box, wherein components of the antenna downlead are distributed in said first, second and third elements composing the X-Y mount, an OrthoMode Transducer type junction included in the upper box enabling separation of the components of the downlead into two separate paths, a first path called an ascending path comprising components for amplifying and processing signals to be transmitted by the antenna, a second path called a descending path comprising components for processing and amplifying signals received by the antenna, the components associated with these two paths being placed respectively on either side of the said first, second and third elements of the X-Y mount, and thus providing balancing.

2. The system claimed in claim 1 wherein the OMT junction is of turnstile type, said junction being composed of a central part, and four coplanar arms disposed in a cross around the central part, two of the coplanar arms being used as short circuits, the other two coplanar arms being respectively connected to the ascending path and to the descending path of the antenna downlead, and a circular arm corresponding to the horn of the antenna of the system.

3. The system claimed in claim 2 wherein the two short circuit arms are removable and interchangeable.

4. The system claimed in claim 2 wherein the short circuit arms are the same length, at least one electrically controlled PIN diode being placed in these two arms at a chosen distance from the base of the arm in such manner as to adjust the length of the short circuit according to whether the diode is open or closed.

5. The system claimed in claim 1 wherein the lower box is connected to the base by a first shaft for rotation about an axis X, the upper box being connected to the lower box by a second shaft for rotation about an axis Y, the axes X and Y being chosen such that they do not intersect.

6. The system claimed in claim 1 wherein the lower box is connected to the base by a first shaft for rotation about an axis X, the upper box being connected to the lower box by a second shaft for rotation about an axis Y, the axes X and Y being chosen in such manner that they are in the same plane.

7. The system claimed in claim 1 wherein for the paths of the antenna, downlead conductivity between the components of the same path is ensured from one element to the other of the mount by the use of simple microwave rotary joints.

8. The system claimed in claim 1 wherein the base comprises a cold box containing at least one power amplifier associated with the ascending path, said box being cooled by the use of a cold plate fixed to the base.

9. The system claimed in claim 8 wherein at least one hydraulic actuator is fixed to the cold plate and to the support on which the antenna system rests, said actuator being controlled electrically or mechanically in such manner as to introduce a static inclination angle between the antenna system and the support.

10. The system claimed in claim 8 wherein at least one linear electric motor is fixed to the cold plate and to the support on which the antenna system rests, said motor being electrically controlled in such manner as to introduce a static angle of inclination between the antenna system and the support.

* * * * *